US007777144B2

(12) United States Patent
Wu et al.

(10) Patent No.: US 7,777,144 B2
(45) Date of Patent: Aug. 17, 2010

(54) METAL KEYPAD PANEL STRUCTURE WITH MICROPORE ARRAY

(75) Inventors: Che-Tung Wu, Taoyuan (TW); Chih-Ho Hsu, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 415 days.

(21) Appl. No.: 12/014,857

(22) Filed: Jan. 16, 2008

(65) Prior Publication Data

US 2009/0128372 A1 May 21, 2009

(30) Foreign Application Priority Data

Nov. 16, 2007 (TW) ..... 96219461 U

(51) Int. Cl.
*H01H 9/00* (2006.01)

(52) U.S. Cl. ..... 200/313

(58) Field of Classification Search ..... 200/310, 200/313, 314, 317

See application file for complete search history.

(56) References Cited

U.S. PATENT DOCUMENTS

| | | | | |
|---|---|---|---|---|
| 4,811,175 | A * | 3/1989 | DeSmet | 200/313 |
| 7,674,992 | B2 * | 3/2010 | Hutchison et al. | 200/314 |
| 7,705,256 | B2 * | 4/2010 | Kenmochi | 200/314 |
| 2007/0205986 | A1 | 9/2007 | Kim et al. | |

* cited by examiner

*Primary Examiner*—Felix O Figueroa
(74) *Attorney, Agent, or Firm*—Chun-Ming Shih; HDLS IPR Services

(57) ABSTRACT

A metal keypad panel structure with a micropore array includes a metal keypad panel, a filling, a pattern layer, a backlight module and an electric signal module. The metal keypad panel has micropores filled with the filling. The pattern layer is on a side of the metal keypad panel. The backlight module is a guide light plate attached onto another side of the metal keypad panel and has patterns, each composed of light guide microstructures. When a light is entered into the guide light plate, the light guide microstructures focus and project the light onto the metal keypad panel to allow users to see the position of each press key clearly.

17 Claims, 16 Drawing Sheets

METAL KEYPAD PANEL STRUCTURE WITH MICROPORE ARRAY

BACKGROUND OF THE INVENTION

1. Field of the Invention

The present invention generally relates to a keypad panel, and more particularly to a metal keypad panel structure.

2. Description of Prior Art

As communication technologies advance continuously, many electronic products are manufactured with a light, thin, short and small design to reduce the size and weight of the electronic products and facilitate users to carry the electronic products. To reduce the size and weight of an electronic product, designers and manufacturers reduce the volume of internal integrated circuits as well as the area and thickness of the operating interface on a surface of the electronic product before the electronic product is installed to a communication device.

Referring to FIGS. 1(*a*) and 1(*b*) for a traditional metal keypad panel as disclosed in U.S. Application Pat. No. 2007/0205986A1, the metal keypad panel 10*a* of this patent application includes an elastic layer 1*a*, a side of the elastic layer 1*a* includes a plurality of protrusions 11*a*, another side of the elastic layer 1*a* corresponding to the protrusion 11*a* includes a plurality of metal press keys 2*a*, each of the metal press keys 2*a* has a hollow portion 21*a* with a corresponding pattern, and a light transmitting resin layer 22*a* is filled into the hollow portion 21*a*. When the metal keypad panel 10*a* is installed into a base 20*a* of an electronic device, the metal keypad panel 10*a* is situated on the electric signal module 30*a*, and the electric signal module 30*a* has a printed circuit board 31*a*, the printed circuit board 31*a* has a plurality of immovable contact points 32*a* disposed thereon, and a metal plate 33*a* is installed onto the circuit board 31*a*. The metal plate 33*a* has a plurality of domes 331, each dome 331*a* with an arc surface corresponds to each contact point 32*a*, and another side of the dome 331*a* corresponds to the protrusion 11*a*. If the metal press key 2*a* is pressed, the protrusion 11*a* is pressed onto the surface of the dome 331*a* to deform the dome 331*a* and contact with the contact point 32*a* to generate an electric signal output. When the backlight source is lit, the light of the backlight source can be passed through a resin layer 22*a* of the metal press key 2*a* to allow users to see the position of each press key clearly.

Although the metal keypad panel 10*a* is manufactured with a light, thin, short and compact design and can be installed and used in a small electronic device, its manufacture requires filling a resin layer 22*a* to a hollow portion 21*a* of all metal press key 2*a* one by one, and then attaching the metal press keys 2*a* precisely onto a side of the elastic layer 1*a* one by one, thus the manufacture of the metal keypad panel 10*a* takes much time and effort and technically involves a high level of difficulty. After the metal keypad panel 10*a* is assembled and combined with the base 20*a*, a gap is formed between the periphery of the metal press key 2*a* and the base 20*a*, thus dusts may be accumulated at the exterior of the keypad panel 10*a* or water may enter into the interior easily, and finally causing an unsmooth operation of the press keys or a short circuit to the internal circuits. Furthermore, there is no reflective effect of any bright line on surfaces of the metal keypad panel 10*a*, so that the metal keypad panel 10*a* is extremely dull in appearance.

SUMMARY OF THE INVENTION

It is a primary objective of the present invention to overcome the foregoing shortcomings by providing a novel metal keypad panel structure, such that the metal keypad panel can be manufactured easily, and accumulated dusts and permeated water can be avoided. In addition, micropores and light guide microstructures are used for displaying patterns on the surface of press keys, and a pattern layer provides a bright wavy line effect to the surface of the metal keypad panel to improve the overall appearance and visual effect of the metal keypad panel.

To achieve the foregoing objective, the present invention provides a metal keypad panel structure with a micropore array, and the metal keypad panel structure includes a metal keypad panel, a filling, a pattern layer, a backlight module, and an electric signal module, wherein the metal keypad panel includes a plurality of micropores, the filling is filled into the micropores, the pattern layer is disposed on a side of the metal keypad panel, the backlight module is a light guide plate attached onto a side of the metal keypad panel, the light guide plate includes a plurality of patterns, each pattern is formed by arranging a plurality of light guide microstructures, the light guide microstructure is concavely disposed on a side inside the light guide plate or convexly disposed on a side of the light guide plate, the electric signal module is attached onto a side of the backlight module, the electric signal module includes a flexible printed circuit board, the printed circuit board includes a plurality of contact points, each contact point corresponds to a metal dome, an adhesive layer is disposed on a side of the printed circuit board and the metal dome includes a dome membrane, the dome membrane includes an adhesive block disposed on a side of the plurality of protrusions of the dome membrane, a protrusion disposed on the adhesive block, a pattern disposed on each light guide plate and corresponding to the protrusion, a light source module disposed on a distal side of the printed circuit board and formed by a plurality of light emitting diodes, and a light source produced by the light emitting diodes corresponds to a side of the light guide plate.

DETAILED DESCRIPTION OF THE INVENTION

The technical characteristics, features and advantages of the present invention will become apparent in the following detailed description of the preferred embodiments with reference to the accompanying drawings.

Figure 1A:
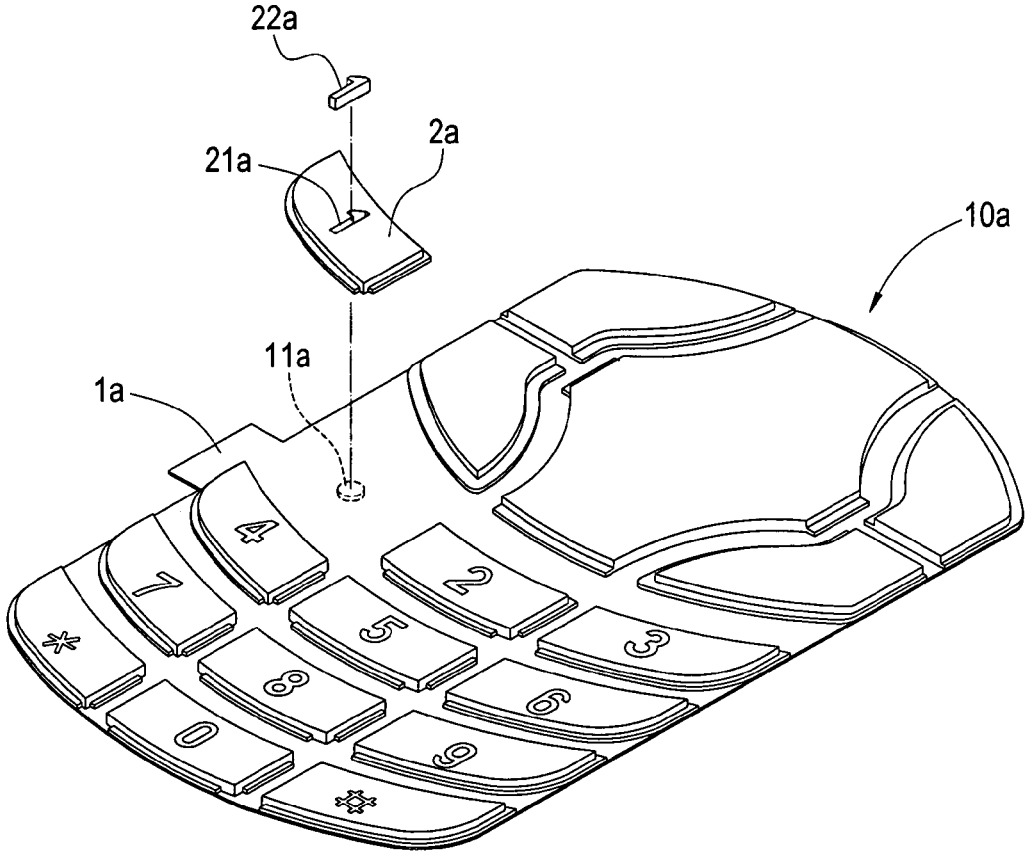
FIG.1(a) PRIOR ART
FIGS. 1(*a*) and 1(*b*) are schematic views of a traditional metal keypad panel.
Figure 1B:
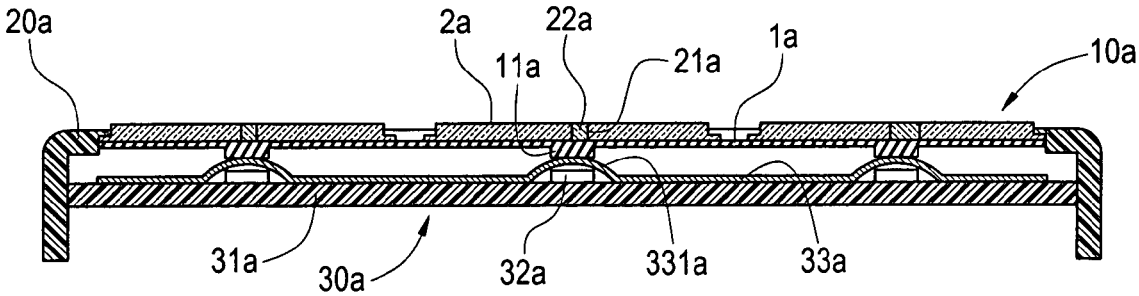
FIG.1(b) PRIOR ART
Figure 2:
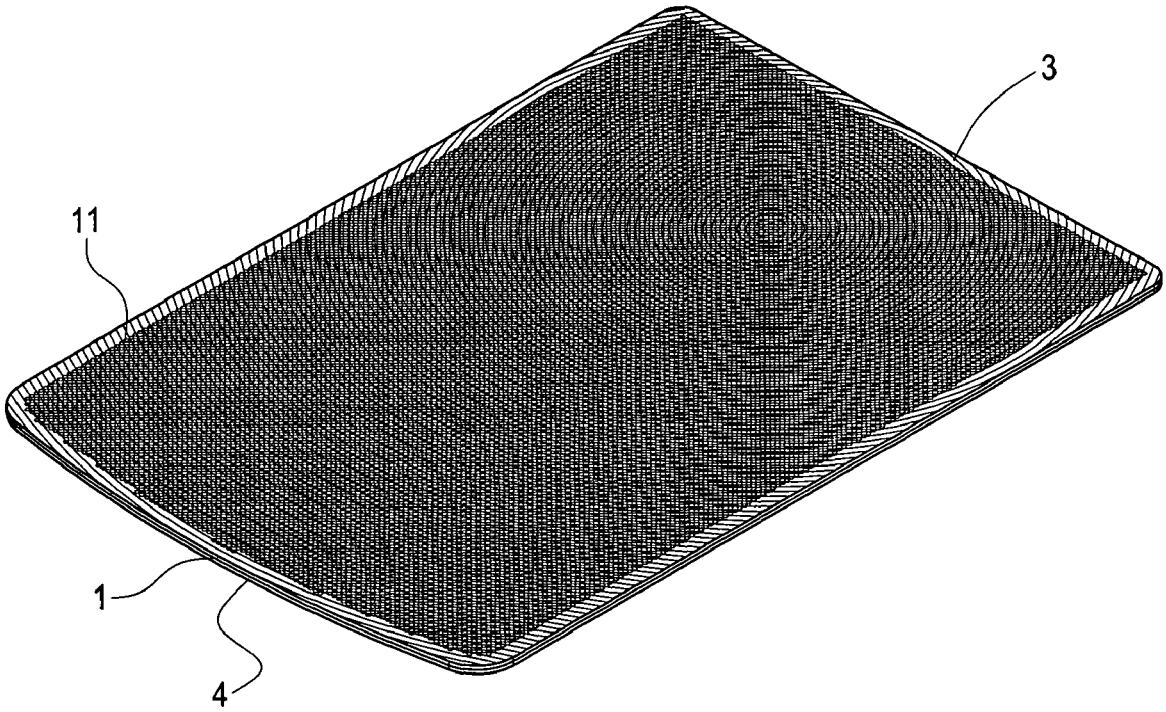
FIG. 2 is a perspective view a metal keypad panel of the present invention.
Figure 3:
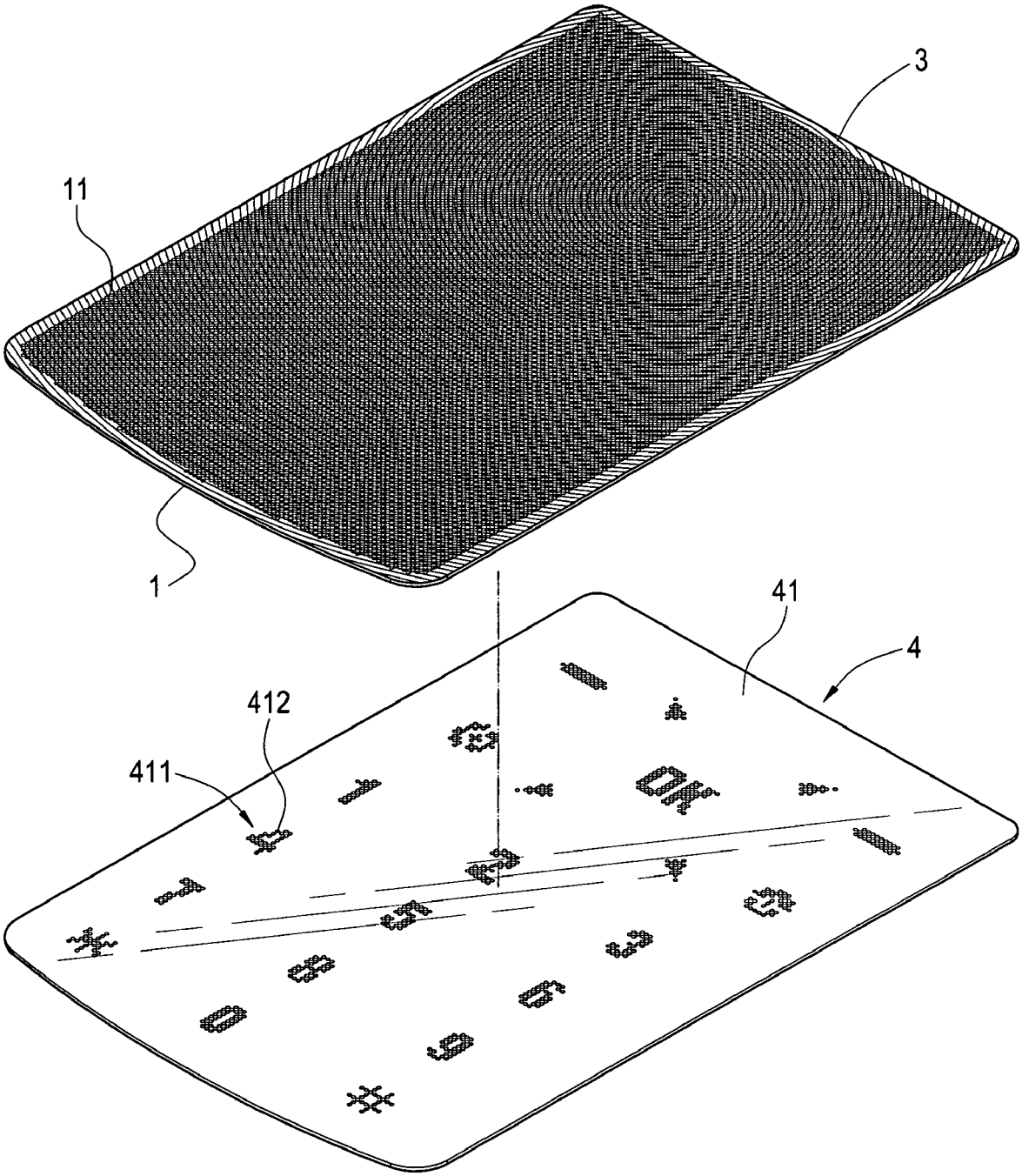
FIG. 3 is a schematic view of combining a metal keypad panel with a backlight module in accordance with the present invention.

Referring to FIGS. 2 and 3 for a perspective and a schematic view of combining a metal keypad panel with a backlight module in accordance with the present invention respectively, the metal keypad panel structure with a micropore array of the invention comprises a metal keypad panel 1, a filling 2, a pattern layer 3 and a backlight module 4.

The metal keypad panel 1 is made of a material such as stainless steel (SUS) or aluminum—Magnesium alloy, and includes a plurality of micropores 11 thereon.

The filling 2 is made of a material such as ultraviolet glue, silicone, vitro, epoxy or synthetic resin, and filled into the micropores 11.

The pattern layer 3 is formed on a side of the metal keypad panel 1. The pattern layer 3 is made of a plastic material such as thermoplastic polyurethane (TPU) or thermoplastic elastomer (TPE). In the figures, the pattern layer 3 has a wavy bright spinning. In the meantime, the pattern layer 3 also constitutes a protecting layer of the metal keypad panel 1.

The backlight module 4 is a light guide plate 41 attached onto a side of the metal keypad panel 1, and the light guide plate 41 includes a plurality of patterns 411, and each pattern 411 is made by arranging a plurality of light guide microstructures 412, and the light guide microstructure 412 is concavely disposed in the light guide plate 41 or convexly disposed on a side of the light guide plate 41. The pattern 411 is in a form such as a number, a text character, a special symbol (#, *, .) and a direction symbol.

Figure 4:
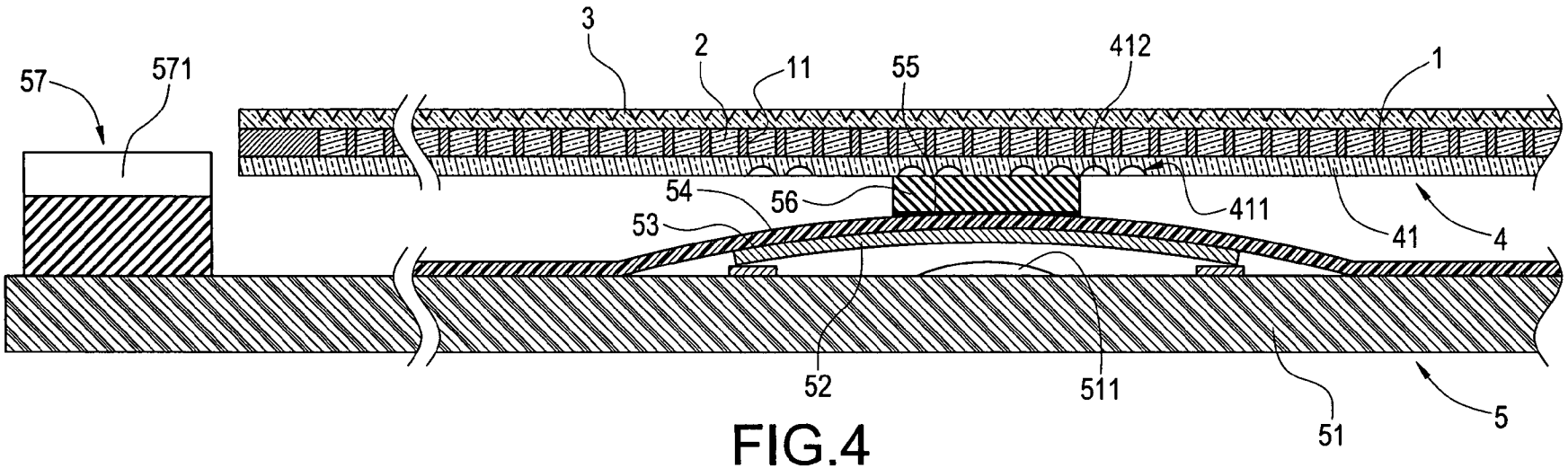
FIG. 4 is a section view of assembling a metal keypad panel with an electric signal module in accordance with the present invention.

Referring to FIG. 4 for a section view of assembling a metal keypad panel with an electric signal module in accordance with the present invention, a metal keypad panel 1 is combined with a filling, a pattern layer 3 and a backlight module 4 into a metal panel, and then combined with the electric signal module 5. The electric signal module 5 is attached on a side of the backlight module 4, and includes a flexible printed circuit board (FPCB) 51, and the printed circuit board 51 includes a plurality of contact points 511, and each contact point 511 corresponds to a metal dome 52, and a side of the printed circuit board 51 and the metal dome 52 includes an adhesive layer 53, and the adhesive layer 53 includes a dome membrane 54 thereon, and the dome membrane 54 includes an adhesive block 55 on a side of the dome membrane 54 having a plurality of protrusions, and each adhesive block 55 includes a protrusion 56 corresponding to each pattern 411 on the light guide plate 41.

Further, a distal side of the printed circuit board 51 includes a light source module 57 comprised of a plurality of light emitting diodes 571, and a light source produced by the light emitting diode 571 corresponds to a side of the light guide plate 41.

Figure 5A:
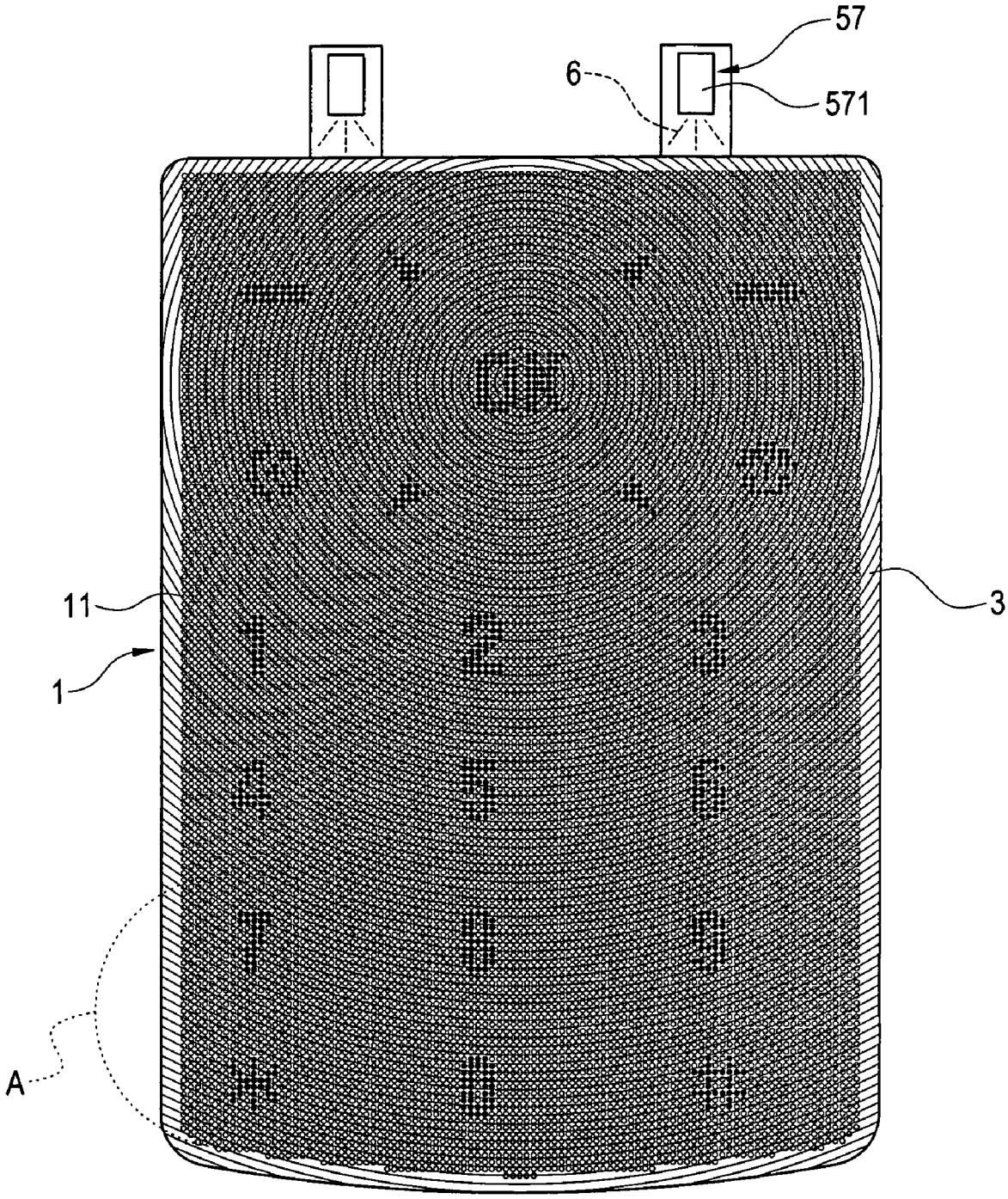
FIGS. 5(*a*) and 5(*b*) show a schematic view of a lit backlight module and an enlarged view of a portion of FIG. 5(*a*) respectively.
Figure 5B:
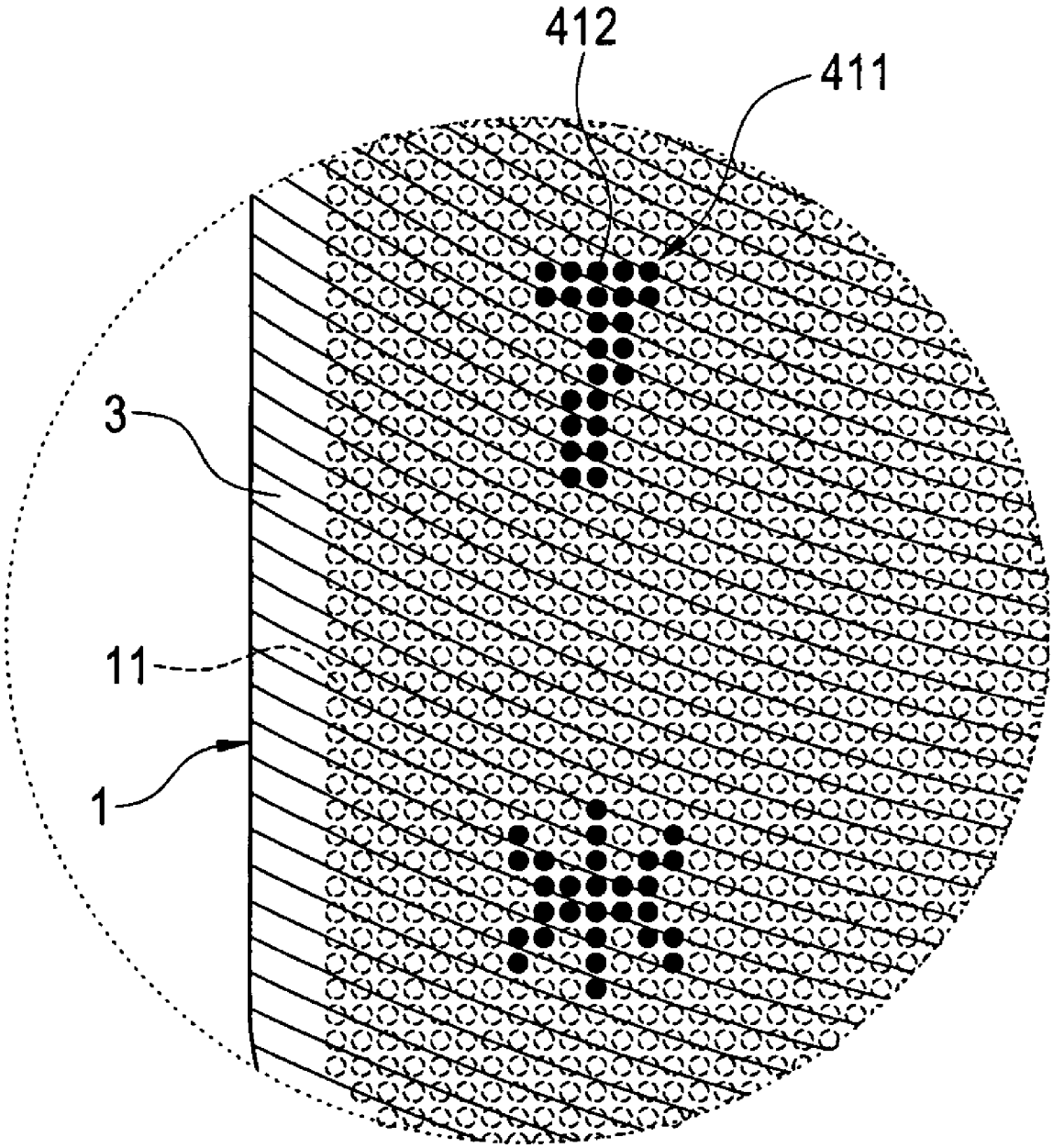

Referring to FIGS. 5(*a*) and 5(*b*) for a schematic view of a lit backlight module and an enlarged view of a portion of FIG. 5(*a*) respectively, when the metal keypad panel 1 is started, a light 6 produced by the light emitting diode 571 of the light source module 57 on the printed circuit board 51 is guided to the inside through a side of the light guide plate 41. After the light 6 is passed through the light guide microstructure 412 of the light guide plate 41, the light guide microstructure 412 will focus and project the light 6 onto the corresponding metal keypad panel 1. By then, an obvious (or bright) pattern 411 displayed by the light guide microstructure 412 appears at the top of the metal keypad panel 1, so that users can see the position of each press key clearly.

Figure 6A:
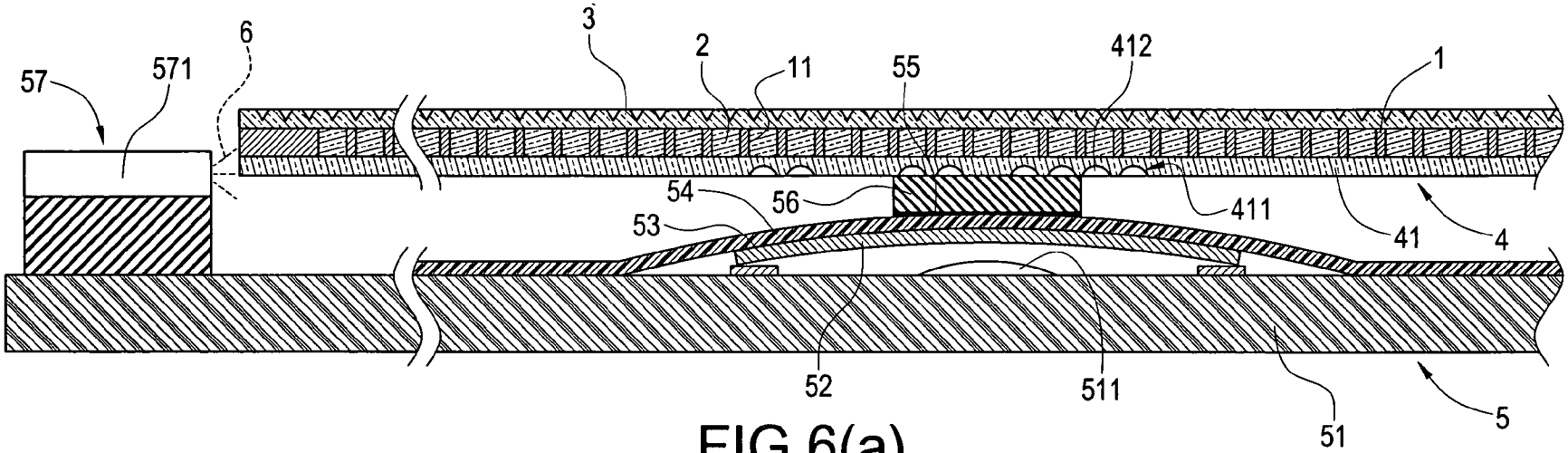
FIGS. 6(*a*) and 6(*b*) show schematic views of pressing a metal keypad panel in accordance with the present invention.
Figure 6B:
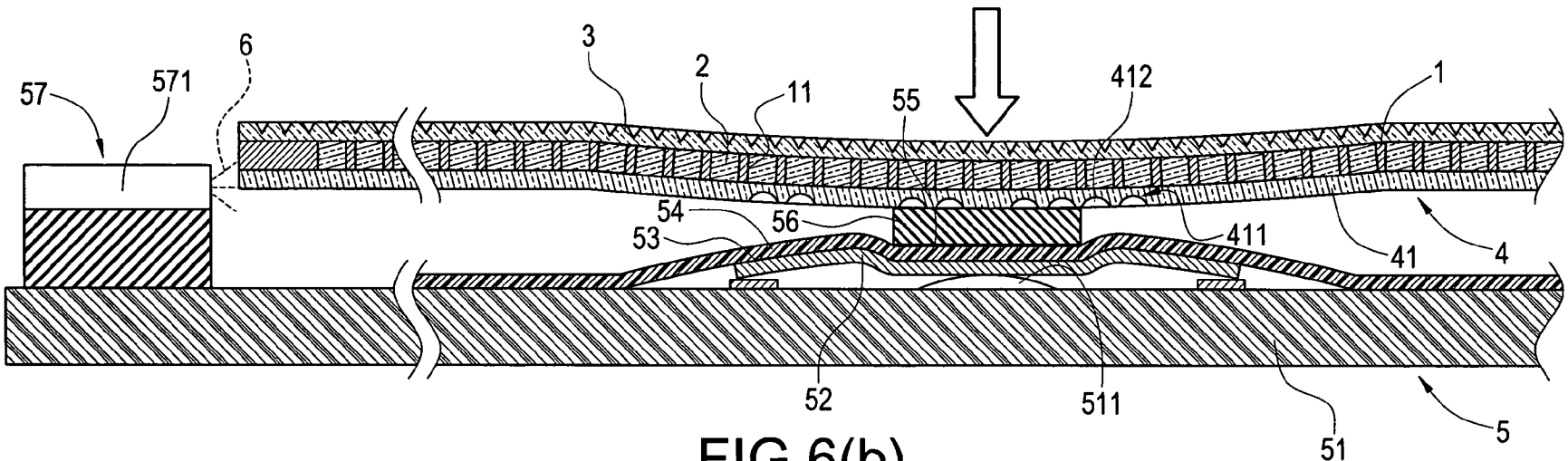

Referring to FIGS. 6(*a*) and 6(*b*) for schematic views of pressing a metal keypad panel in accordance with the present invention, if an external force is exerted onto a side of the metal keypad panel 1 to press and deform the metal keypad panel 1, the protrusion 56 is driven to press onto the dome membrane 54, such that the metal dome 52 is deformed and pressed down to a position in contact with the contact point 511 to generate an output of conducting signal. If no external force is exerted onto a side of the metal keypad panel 1, the metal panel 1 will rise and resume its original status due to the resilience of the metal keypad panel 1 and the metal dome 52.

Figure 7A:
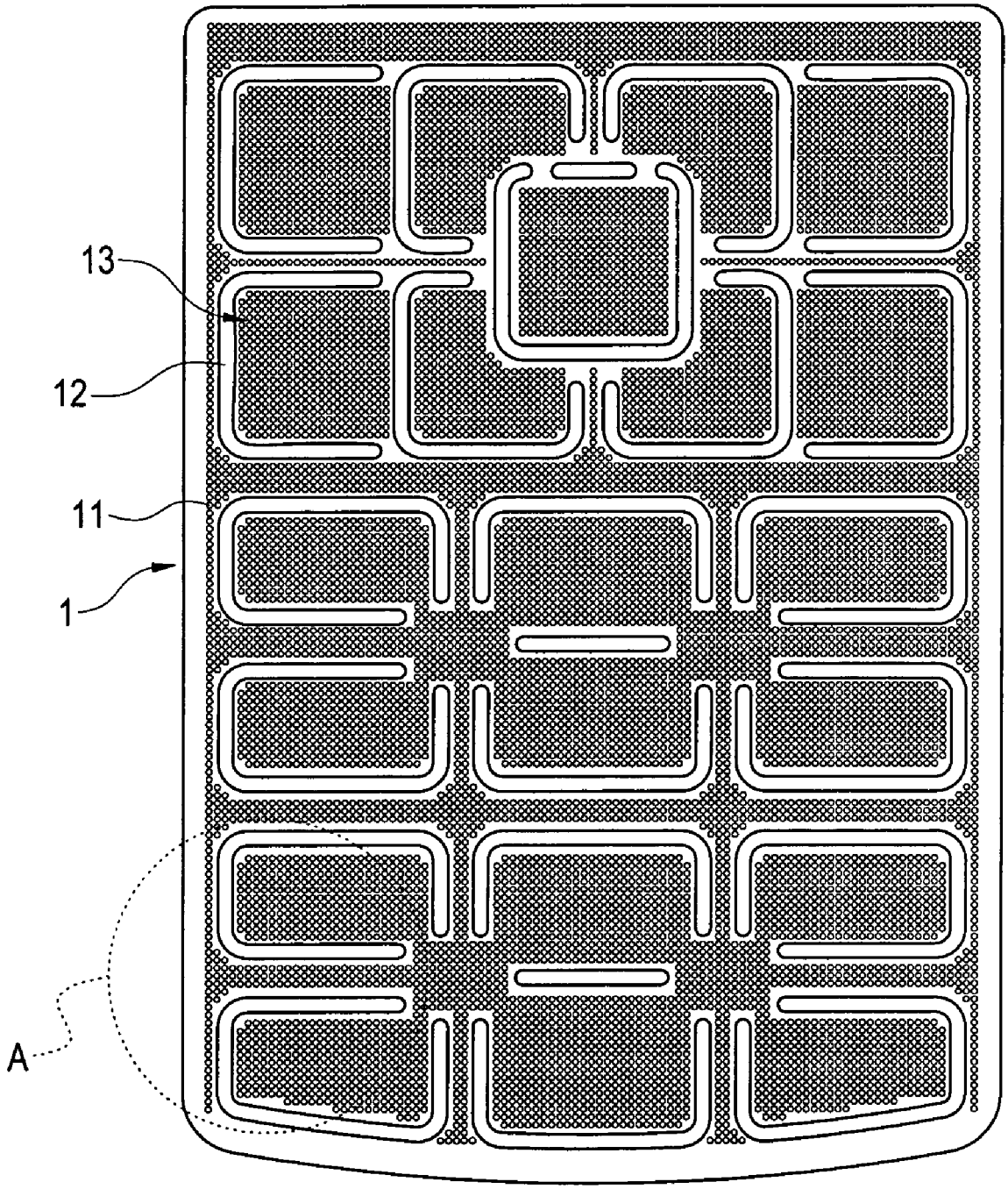
FIGS. 7(*a*) and 7(*b*) show a schematic view of another preferred embodiment of the present invention and an enlarged view of a portion of FIG. 7(*a*) respectively.
Figure 7B:
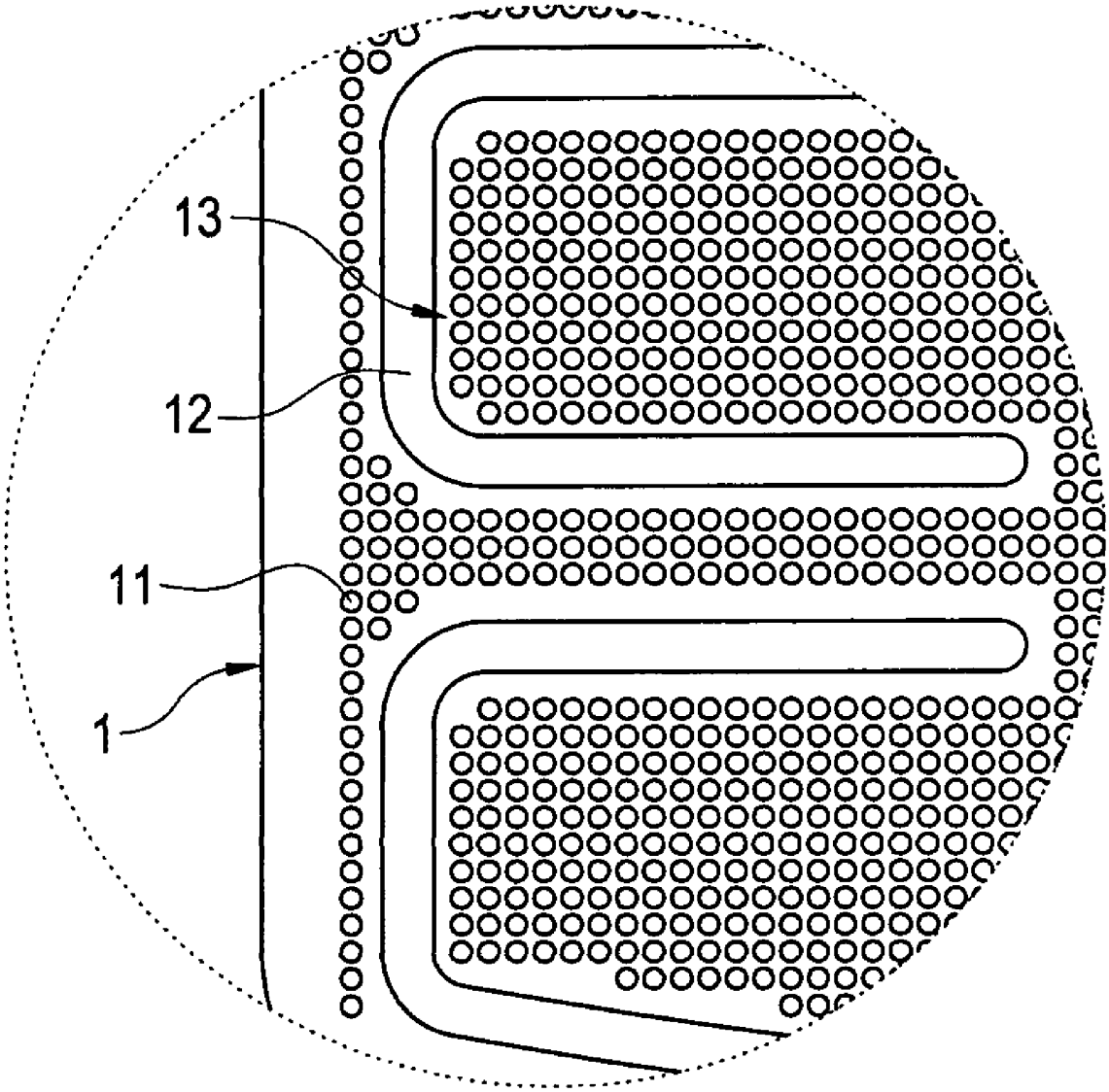

Referring to FIGS. 7(*a*) and 7(*b*) for a schematic view of another preferred embodiment of the present invention and an enlarged view of a portion of FIG. 7(*a*) respectively, a line hollow portion 12 is also etched on the micropores 11 when the micropores 11 of the metal keypad panel 1 are etched in Step 102, and the line hollow portion 12 is enclosed into a press zone 13, and the press zone 13 clearly defines the distributed position of each press key, and makes the pressing of the press zone 13 easy.

Figure 8A:
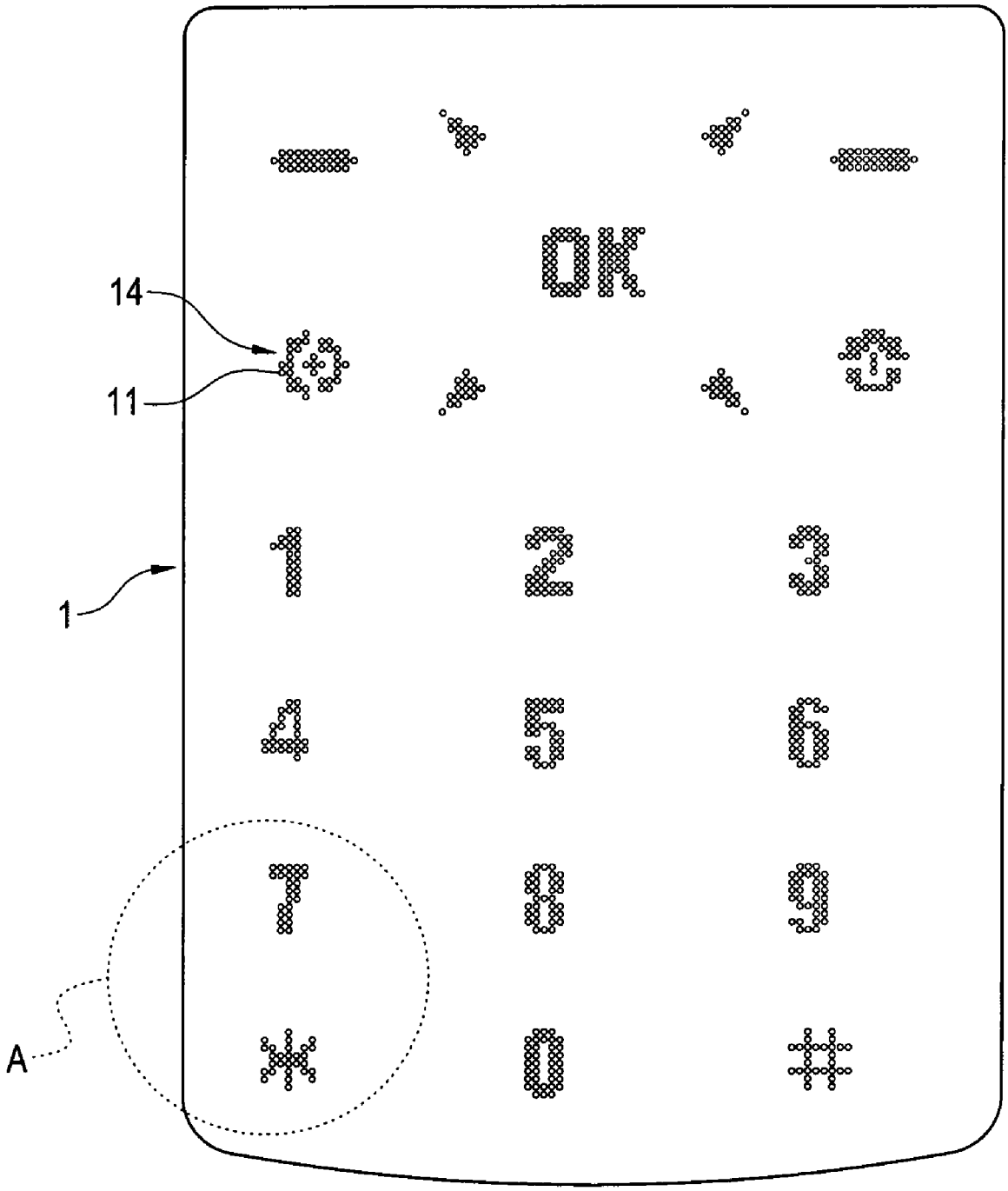
FIGS. 8(*a*) and 8(*b*) show a schematic view of a further preferred embodiment of the present invention and an enlarged view of a portion of FIG. 8(*a*) respectively.
Figure 8B:
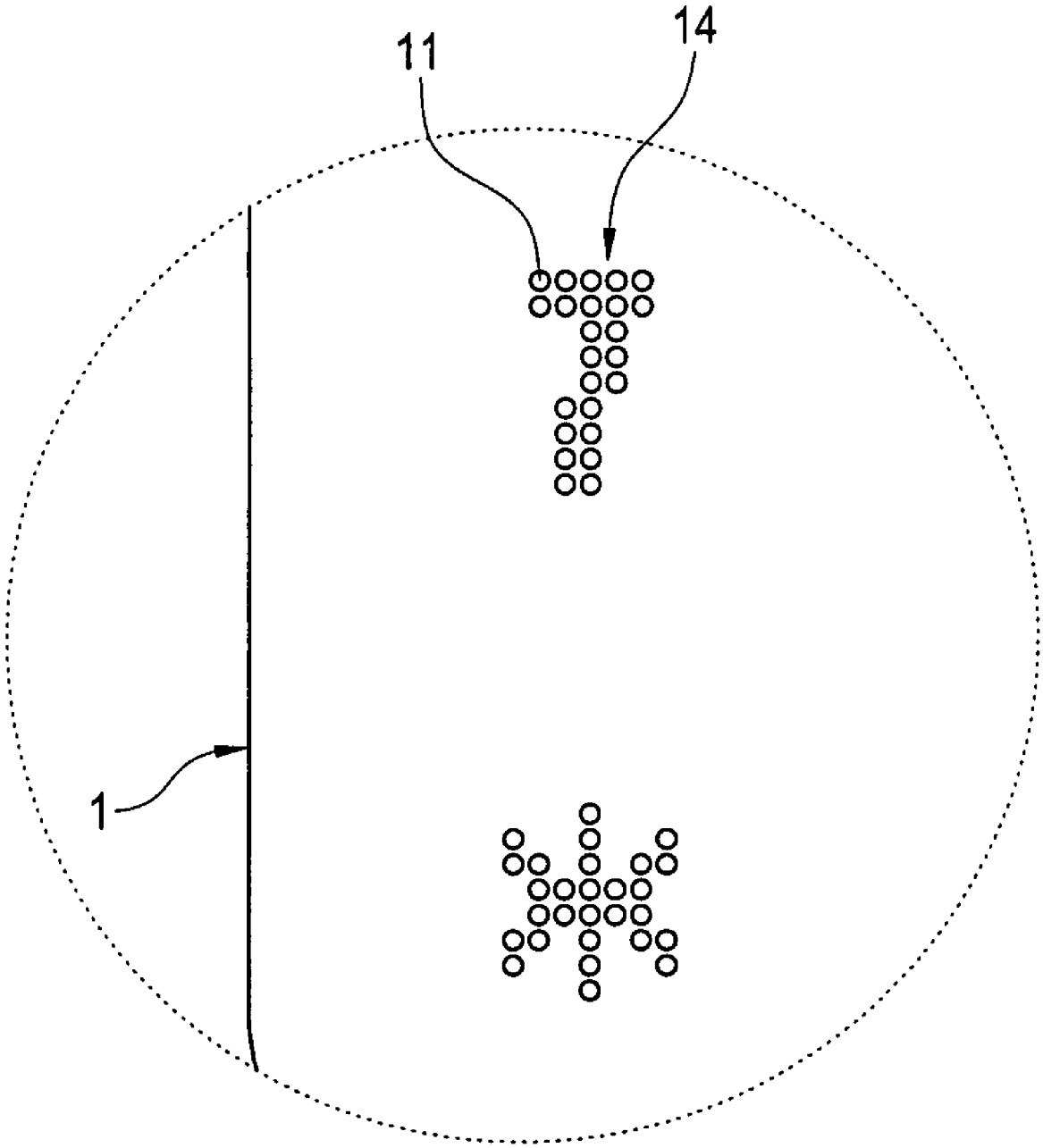

Referring to FIGS. 8(*a*) and 8(*b*) for a schematic view of a further preferred embodiment of the present invention and an enlarged view of a portion of FIG. 8(*a*) respectively, the micropores 11 are etched only on the area of the metal keypad panel 1 that displays the pattern 14, when the micropores 11 of the metal keypad panel 1 are etched in Step 102, and the pattern 14 is formed by a plurality of micropores 11.

If a light guided by a backlight module and projected towards the metal keypad panel 1 passes through the micropores 11 in the pattern 14, the shape of the pattern 14 including numbers, texts, special symbols (#, *, .) and direction symbols will be shown.

Figure 9:
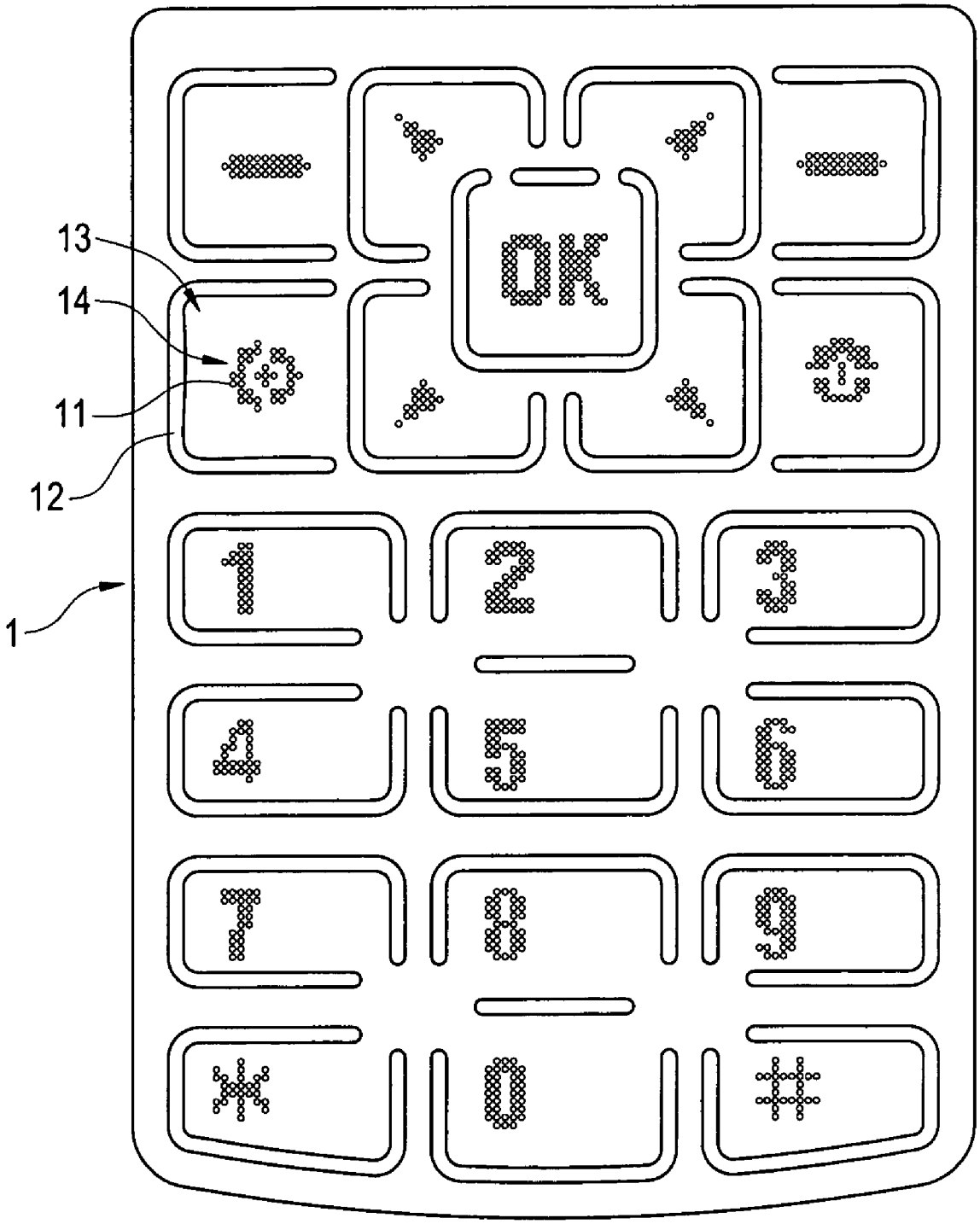
FIG. 9 is a schematic view of another preferred embodiment of the present invention.

Referring to FIG. 9 for a schematic view of a further preferred embodiment of the present invention, a line hollow portion 12 is etched on the periphery of the pattern 14 when the pattern 14 of the metal keypad panel 1 is formed, and the line hollow portion 12 is enclosed into a press zone 13. The press zone 13 clearly defines the distributed position of each press key, and the hollow portion 12 makes the pressing of the press zone 13 easy.

Figure 10:
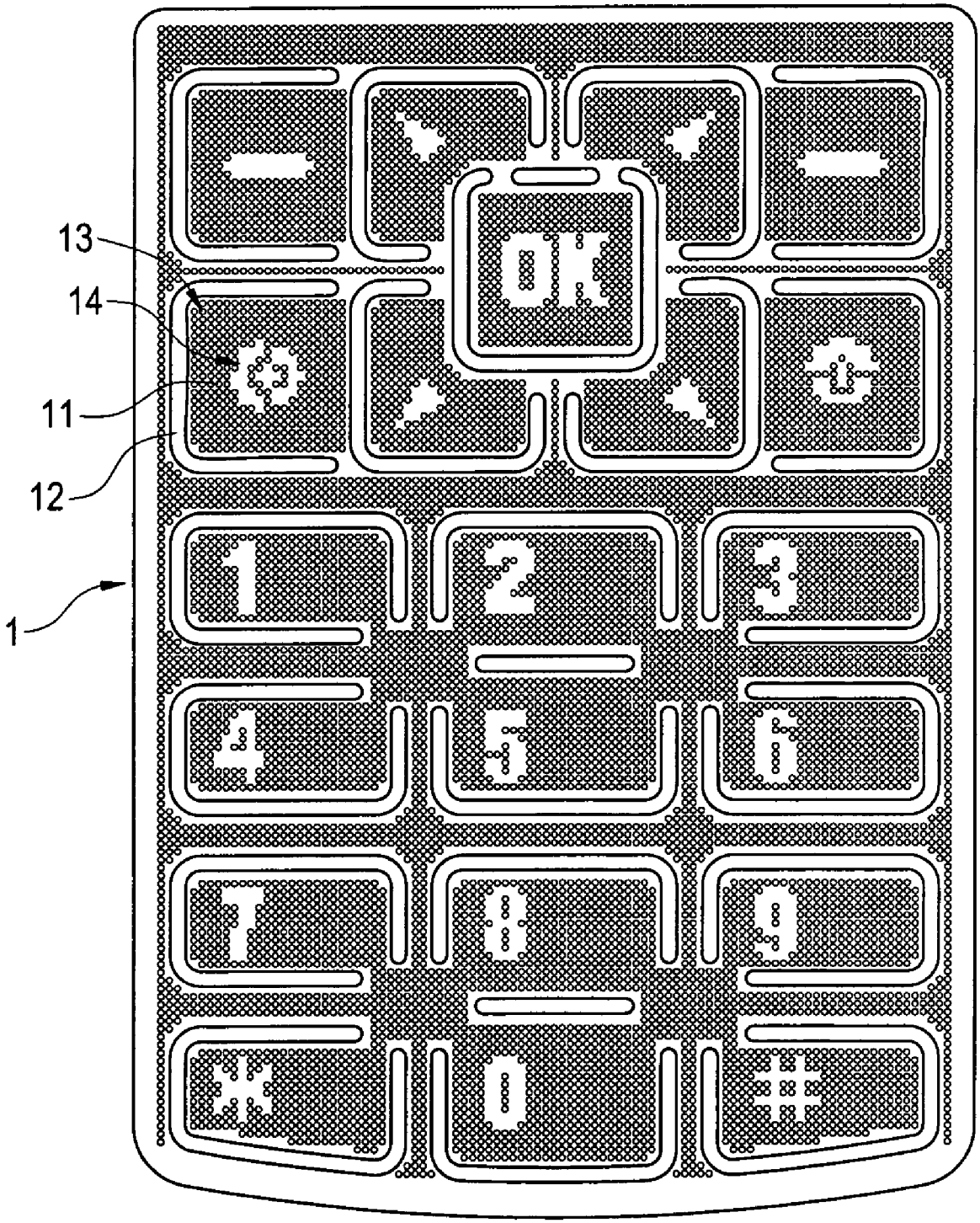
FIG. 10 is a schematic view of another further preferred embodiment of the present invention.

Referring to FIG. 10 for a schematic view of another further preferred embodiment, a line hollow portion 12 is also etched on the micropores 11 when the micropores 11 of the metal keypad panel 1 are etched, and the line hollow portion 12 is enclosed into a press zone 13. The press zone 13 allows users to know the distributed position of each press key, and the design of the pattern 14 on the press zone 13 does not have any micropore 11. Therefore, when the backlight module is lit, the pattern 14 is opaque, and the micropores 11 and the line hollow portion 12 on the metal keypad panel 1 are in a light transmitting status, so that users can clearly see the position of each press key.

Figure 11:
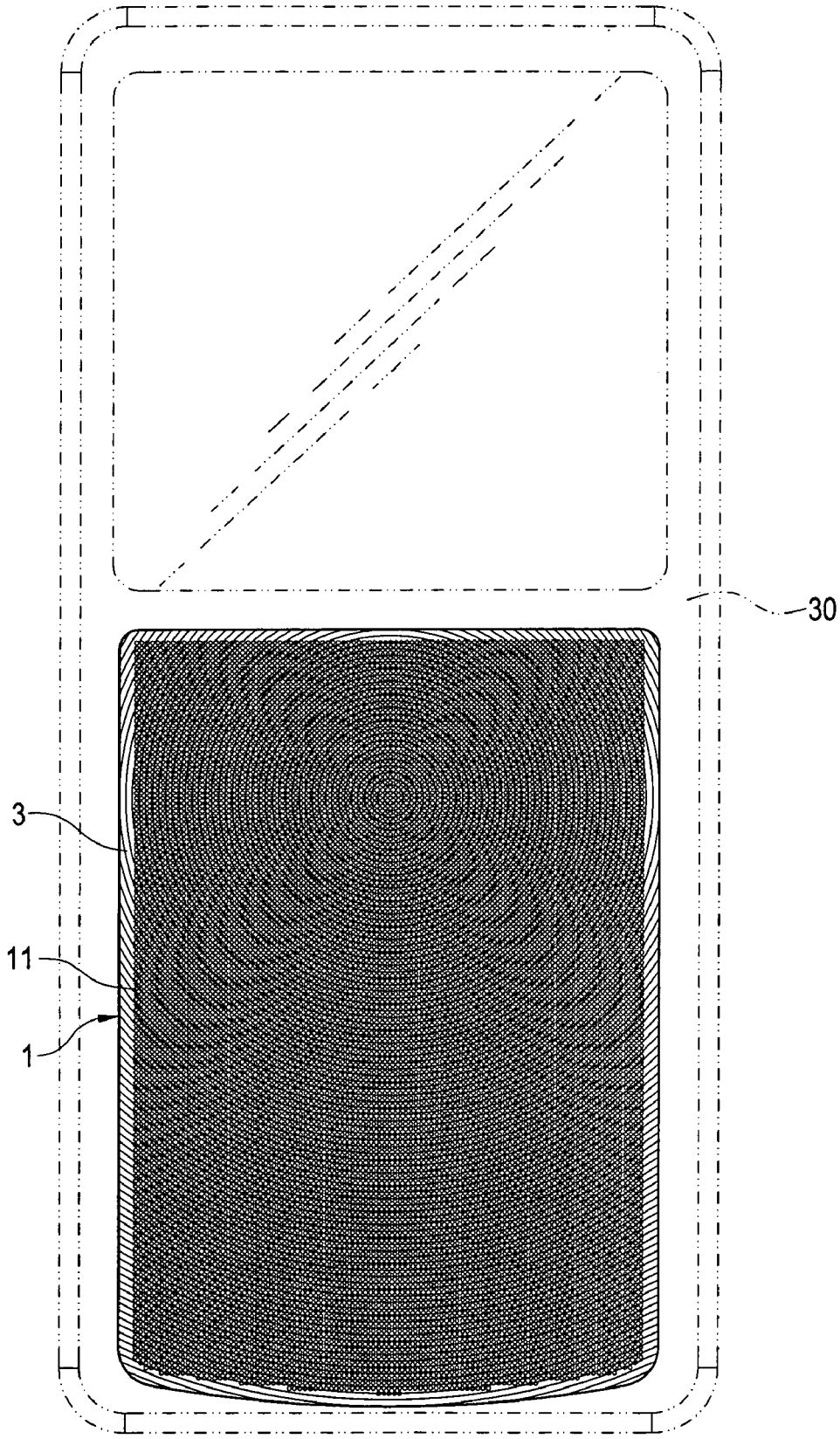
FIG. 11 is a schematic view of a metal keypad panel used in a mobile phone in accordance with the present invention.

Referring to FIG. 11 for a schematic view of a metal keypad panel used in a mobile phone in accordance with the present invention, external light is projected onto the pattern layer 3 of the metal keypad panel 1 after the metal keypad panel 1 of the invention is produced and applied to the mobile phone 30. The pattern layer 3 will produce a wavy light reflection effect to improve the overall aesthetic appearance of the mobile phone 30. In the meantime, the pattern layer 3 is provided for protecting the surface of the metal keypad panel 1 from being damaged from hard objects.

Figure 12:
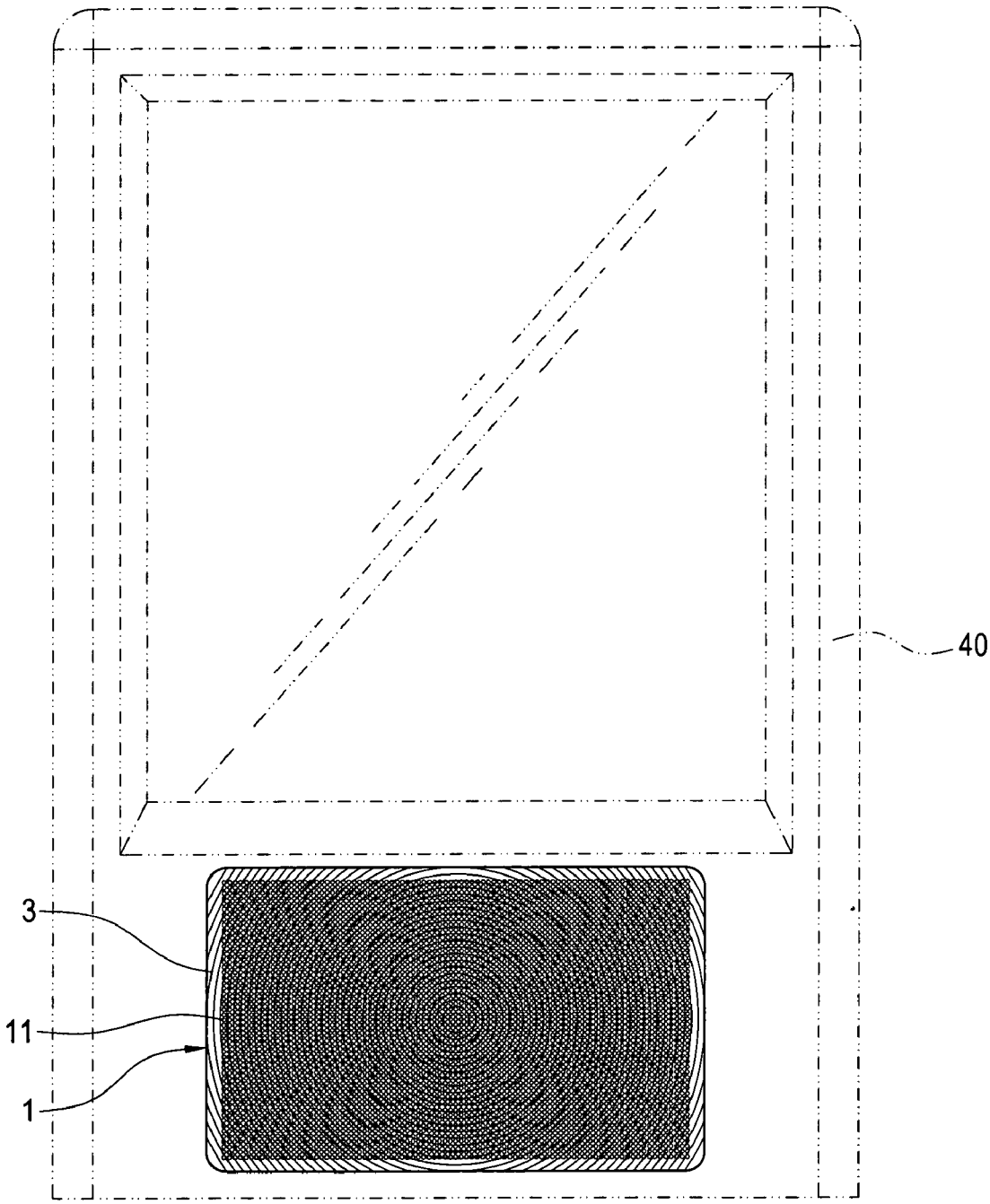
FIG. 12 is a schematic view of a metal keypad panel used in a personal digital assistant in accordance with the present invention.

Referring to FIG. 12 for a schematic view of a metal keypad panel used in a personal digital assistant in accordance with the present invention, the metal keypad panel 1 can be applied to a mobile phone 30 as well as a personal digital assistant (PDA) 40 after the metal keypad panel 1 of the invention is produced. When light is projected onto the pattern layer 3 of the metal keypad panel 1, the pattern layer 3 will produce a wavy light reflection effect to enhance the overall aesthetic appearance of the personal digital assistant (PDA) 40.

Figure 13:
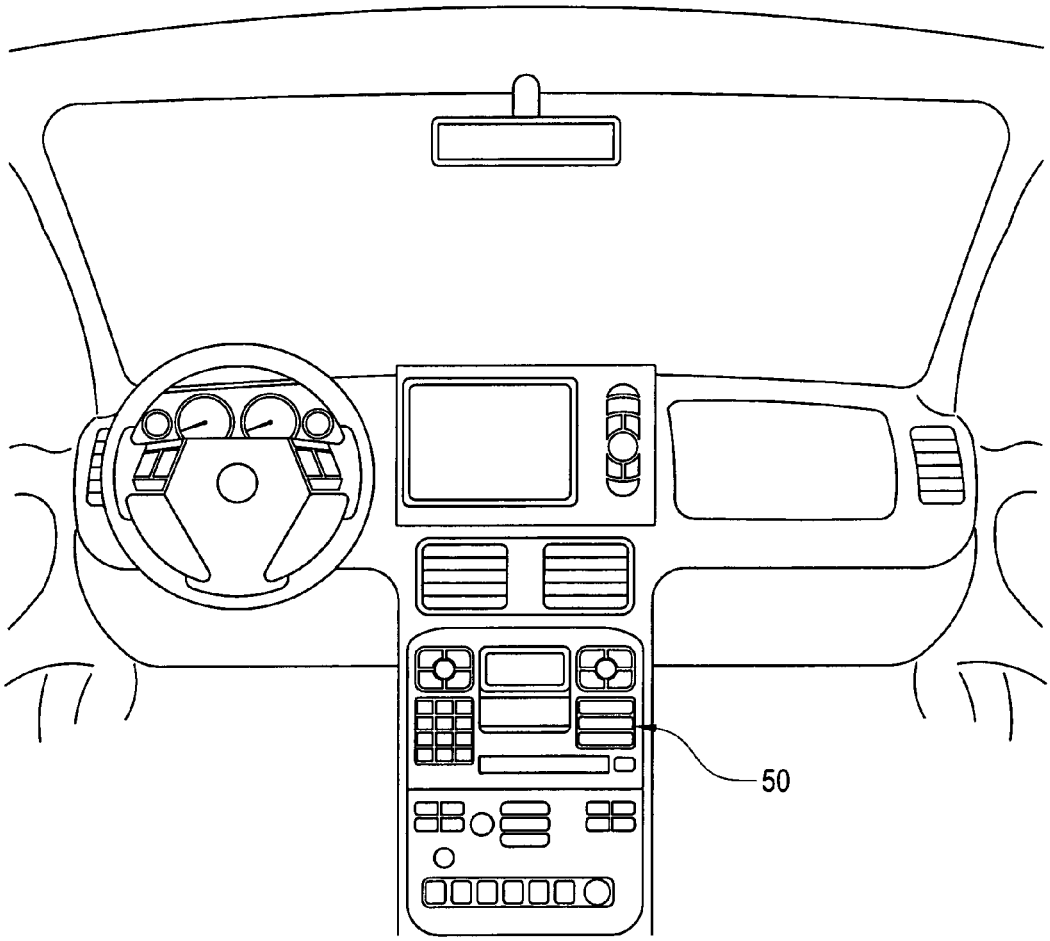
FIG. 13 is a schematic view of a metal keypad panel used in an automobile stereo panel in accordance with the present invention.

Referring to FIG. 13 for a schematic view of a metal keypad panel used in an automobile stereo panel in accordance with the present invention metal keypad panel, a keypad structure of the invention can be applied to the mobile phone 30, a personal digital assistant (PDA) 40 as well as an automobile stereo panel 50 for controlling the operation of an air-conditioned system, an audio/video system and a satellite navigation system.

While the invention is described in by way of examples and in terms of preferred embodiments, it is to be understood that the invention is not limited thereto. On the contrary, the aim is to cover all modifications, alternatives and equivalents falling within the spirit and scope of the invention as defined by the appended claims.

What is claimed is:

1. A metal keypad panel structure with a micropore array, installed on a metal panel of an electronic device, comprising:

a backlight module, having a light guide plate, and a plurality of patterns disposed on the light guide plate and composed of a light guide microstructure;

a metal keypad panel, installed on a side of the backlight module, and having a plurality of micropores disposed thereon;

a filling, filled into the micropores;

a pattern layer, disposed on a surface of the metal keypad panel;

an electric signal module, attached onto a side of the backlight module, and having a flexible printed circuit board;

a plurality of contact points, disposed on the printed circuit board, each corresponding to a metal dome;

an adhesive layer, disposed separately on sides of the printed circuit board and the metal dome, and having a dome membrane; and an adhesive block, disposed on a side with a plurality of protruding positions of the dome membrane, and having a protrusion corresponding to a pattern on each light guide plate; and a light source module, installed on the printed circuit board, and comprised of a plurality of light emitting diodes, and a position of the light emitting diode for producing a light source being corresponding to a side of a light guide plate.

2. The metal keypad panel structure with a micropore array of claim 1, wherein the pattern is one selected from the collection of a number, a text, a special symbol and a direction symbol.

3. The metal keypad panel structure with a micropore array of claim 1, wherein the light guide microstructure is concavely or convexly disposed on an internal side or external side of the light guide plate.

4. The metal keypad panel structure with a micropore array of claim 1, wherein the metal keypad panel further comprises a line hollow portion, and the line hollow portion being enclosed to form a press zone.

5. The metal keypad panel structure with a micropore array of claim 1, wherein the filling is one selected from the collection of an ultraviolet glue, a silicone, a vitro, an epoxy and a synthetic resin.

6. The metal keypad panel structure with a micropore array of claim 1, wherein the pattern layer is made of a material selected from the collection of thermoplastic polyurethane (TPU) and thermoplastic elastomer (TPE).

7. A metal keypad panel structure with a micropore array, installed on a metal panel of an electronic device, comprising:

backlight module, having a light guide plate;

a metal keypad panel, installed on a side of the backlight module, and having a plurality of patterns disposed thereon, and the pattern being composed of micropores; a filling, filled into the micropores; and a pattern layer, disposed on a surface of the metal keypad panel;

an electric signal module, attached onto a side of the backlight module, and having a flexible printed circuit board;

a plurality of contact points, disposed on the printed circuit board, each corresponding to a metal dome;

an adhesive layer, disposed separately on sides of the printed circuit board and the metal dome, and having a dome membrane;

an adhesive block, disposed on a side with a plurality of protruding positions of the dome membrane, and having a protrusion corresponding to a pattern on each light guide plate; and a light source module, installed on the printed circuit board, and comprised of a plurality of light emitting diodes, and a position of the light emitting diode for producing a light source being corresponding to a side of a light guide plate.

8. The metal keypad panel structure with a micropore array of claim 7, wherein the pattern is one selected from the collection of a number, a text, a special symbol and a direction symbol.

9. The metal keypad panel structure with a micropore array of claim 7, wherein the pattern the metal keypad panel further comprises a line hollow portion, and the line hollow portion being enclosed to form a press zone.

10. The metal keypad panel structure with a micropore array of claim 7, wherein the filling is one selected from the collection of an ultraviolet glue, a silicone, a vitro, an epoxy and a synthetic resin.

11. The metal keypad panel structure with a micropore array of claim 7, wherein the pattern layer is made of a material selected from the collection of thermoplastic polyurethane (TPU) and thermoplastic elastomer (TPE).

12. A metal keypad panel structure with a micropore array, installed on a metal panel of an electronic device, comprising:

a backlight module, having a light guide plate;

a metal keypad panel, installed on a side of the backlight module, and having a plurality of micropores disposed thereon, and a plurality of patterns disposed in the micropore array;

a filling, filled into the micropores;

a pattern layer, disposed on a surface of the metal keypad panel;

an electric signal module, attached onto a side of the backlight module, and having a flexible printed circuit board;

a plurality of contact points disposed on the printed circuit board, each corresponding to a metal dome;

an adhesive layer, disposed separately on sides of the printed circuit board and the metal dome, and having a dome membrane; and an adhesive block, disposed on a side with a plurality of protruding positions of the dome membrane, and having a protrusion corresponding to a pattern on each light guide plate.

13. The metal keypad panel structure with a micropore array of claim 12, wherein the pattern is one selected from the collection of a number, a text, a special symbol and a direction symbol.

14. The metal keypad panel structure with a micropore array of claim 12, wherein the metal keypad panel further comprises a line hollow portion, and the line hollow portion being enclosed to form a press zone.

15. The metal keypad panel structure with a micropore array of claim 12, wherein the filling is one selected from the collection of an ultraviolet glue, a silicone, a vitro, an epoxy and a synthetic resin.

16. The metal keypad panel structure with a micropore array of claim 12, wherein the pattern layer is made of a material selected from the collection of thermoplastic polyurethane (TPU) and thermoplastic elastomer (TPE).

17. The metal keypad panel structure with a micropore array of claim 12, wherein the printed circuit board includes a light source module thereon, and the light source module is comprised of a plurality of light emitting diodes, and a light source produced by the light emitting diode corresponds to a side of the light guide plate.

* * * * *